US006064347A

United States Patent [19]

Fordham

[11] Patent Number: 6,064,347

[45] Date of Patent: May 16, 2000

[54] DUAL FREQUENCY, LOW PROFILE ANTENNA FOR LOW EARTH ORBIT SATELLITE COMMUNICATIONS

[75] Inventor: Jeffrey Fordham, Alpharetta, Ga.

[73] Assignee: Scientific-Atlanta, Inc., Norcross, Ga.

[21] Appl. No.: 08/998,638

[22] Filed: Dec. 29, 1997

[51] Int. Cl.[7] ..... H01Q 9/00

[52] U.S. Cl. ..... 343/749; 343/752; 343/742; 343/867

[58] Field of Search ..... 343/700 MS, 749, 343/752, 741, 742, 743, 866, 867

[56] References Cited

U.S. PATENT DOCUMENTS

| | | | |
|---|---|---|---|
| 1,987,780 | 1/1935 | Latour | 343/824 |
| 2,412,249 | 12/1946 | Brown et al. | 343/705 |
| 2,472,106 | 6/1949 | Hansen | 343/873 |
| 2,750,589 | 6/1956 | Harris | 343/827 |
| 5,181,044 | 1/1993 | Matsumoto et al. | 343/752 |
| 5,258,892 | 11/1993 | Stanton et al. | 361/814 |
| 5,337,061 | 8/1994 | Pye et al. | 343/702 |
| 5,363,114 | 11/1994 | Shoemaker | 343/828 |
| 5,420,599 | 5/1995 | Erkocevic | 343/828 |
| 5,481,271 | 1/1996 | Hai et al. | 343/749 |
| 5,550,554 | 8/1996 | Erkocevic | 343/828 |
| 5,557,293 | 9/1996 | McCoy et al. | 343/867 |
| 5,600,339 | 2/1997 | Oros | 343/825 |
| 5,706,016 | 1/1998 | Harrison, II | 343/749 |
| 5,784,032 | 7/1998 | Johnson et al. | 343/702 |
| 5,838,283 | 11/1998 | Nakano | 343/741 |

*Primary Examiner*—Don Wong
*Assistant Examiner*—Tan Ho
*Attorney, Agent, or Firm*—Kenneth M. Massaroni; Kelly A. Gardner; Hubert J. Barnhardt III

[57] ABSTRACT

A top-loaded, vertically polarized antenna (10) comprised of two ring radiators (108, 110) formed into loops to provide a dual resonant frequency antenna less than 8 inches on a side for use in the 130 to 150 MHz frequency band. By using separate transmit and receive elements, separate resonant frequencies can be provided without the use of lossy duplexers. The antenna can be concealed inside a housing also containing the radio equipment.

23 Claims, 1 Drawing Sheet

DUAL FREQUENCY, LOW PROFILE ANTENNA FOR LOW EARTH ORBIT SATELLITE COMMUNICATIONS

TECHNICAL FIELD

This invention relates to antennas. In particular this invention relates to a dual-frequency, VHF-frequency band device suitable for communicating with low earth orbit satellites.

BACKGROUND OF THE INVENTION

Satellite-based communications systems are well known. Such systems are frequently used to provide communications between a fixed terrestrial base station and widely spaced fixed or mobile subscriber units. The subscriber units might be used for voice or data communications and instances where the location, or status of a vehicle or other equipment is to be monitored, a satellite-based system ensures that communication between the fixed site terrestrial base station and the subscriber units can be maintained. Existing cellular communication networks for example do not provide cellular communications in all portions of the country. Similarly, land line communications may not be available either.

A satellite communications system can enable automatic and remote collection of data from utility meters or other equipment interfaced to subscriber communication units that can communicate with a satellite. Data collected by a remote subscriber communication unit can be uploaded to a satellite. The satellite can thereafter download the data it collected from the subscriber unit to a terrestrial base station from which the data can be passed to a processing center. A subscriber communicator that collects data from utility meters, and the like is preferably inconspicuous, weatherproof, and inexpensive enough such that the device would not be damaged by vandalism, weather or be so prohibitively costly as to make its commercial effectiveness questionable.

A problem with communicating with an overhead satellite, is of course that the subscriber communicator must be able to send and receive radio frequency signals to and from the satellite. In addition to a radio transmitter sufficiently robust to produce a signal, such a subscriber unit must of course have a radiating device that can permit such communications to take place. Improving antenna performance, particularly spatial coverage of the radiation pattern, in the process can reduce the output power that a transmitter must develop. In applications such as residential data collection, an antenna is preferably concealed to reduce the likelihood of being damaged by vandalism or the environment.

A low profile antenna which can be hidden and which will produce acceptable gain in the frequency bands required to communicate with the satellite would facilitate the commercial viability of satellite based data collection systems.

Accordingly it is an object of the present invention to provide a low profile, concealed antenna system for use with a low earth orbit satellite data system.

SUMMARY OF THE INVENTION

A top loaded, vertically polarized antenna that has two resonant frequencies, which can be concealed yet has sufficient signal gain is comprised of at least two planer metal strips, each of a predetermined length, each formed into substantially rectangular rings spaced by a predetermined distance and coupled to ground through a common shorting post. The two rings are each separated from each other by a predetermined distance and in turn separated from a finite ground plane to which they are substantially parallel.

Each ring radiator is of a slightly different dimension thereby providing to the antenna two different resonant frequencies. One ring radiator comprises a receive frequency radiator element to which is coupled a coaxial cable that can be coupled to a radio receiver. The dimensions of the receive frequency radiator are selected to provide a resonant frequency of the antenna for a receiver coupled to the antenna. The second ring radiator of a second dimension comprises a transmitter ring radiator to which is attached a second coaxial cable affixed to the radiator at another distance from the shorting post.

By shaping the substantially planar loading elements into rectangular loops the top loaded vertically polarized antenna can be compacted into a small volume, which provides two resonant frequencies, two distinct input points to the antenna precluding the necessity of a lossy antenna duplexer or other coupling device.

DETAILED DESCRIPTION OF THE PREFERRED EMBODIMENT

Figure 1:
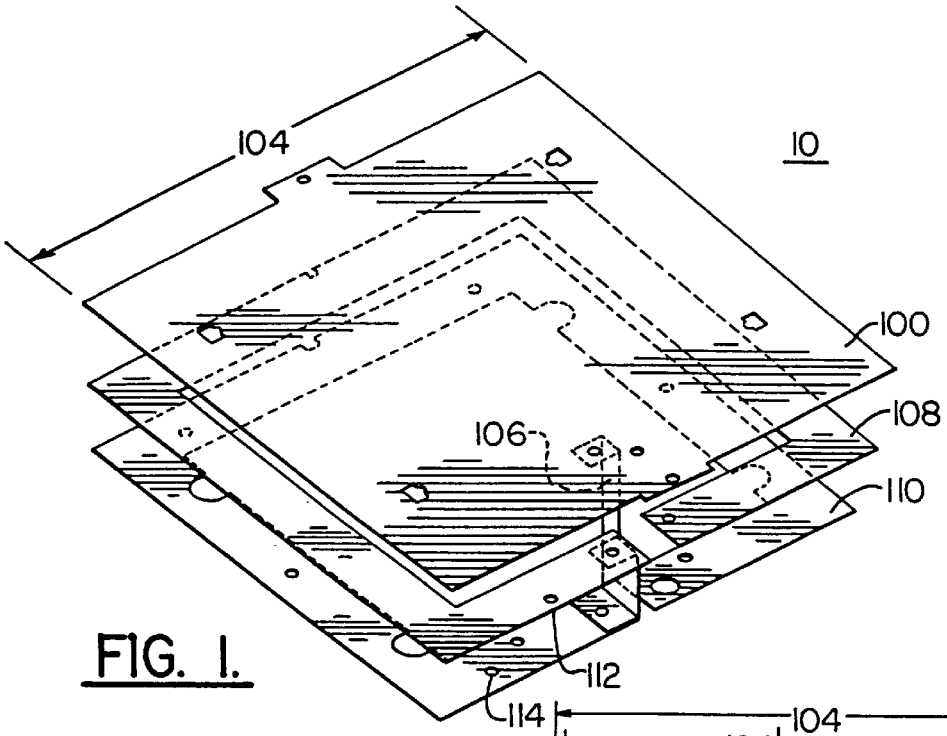
FIG. 1 shows a perspective view of a top-loaded, vertically polarized antenna comprised of two ring radiators formed or shaped into nearly square loops each of which is coupled at one end to a ground plane.

While the specification concludes with claims defining the features of the invention that are regarded as novel, it is believed that the invention will be better understood from a consideration of the following description in conjunction with the drawing figures, in which like reference numerals are carried forward.

FIG. 1 shows a perspective view of a top-loaded, vertically polarized antenna 10. The antenna 10 is comprised of an electrically conductive finite ground plane 100 that provides an electrical reference potential for signals received at or emitted from the antenna 10. A metallic shorting post 106 is affixed orthogonally and electrically coupled to the ground plane 100 and supports two antenna elements that are ring radiators, substantially as shown.

The shorting post 106 supports two ring radiators 108, 110 which as depicted in FIG. 1 resemble square-shaped loops or rings. The first ring radiator 108, and the second ring radiator 110 are preferably stamped from copper, aluminum or some other good conductor of electricity to have a predetermined perimeter dimension measured by the sum of the external dimensions of each loop 108, 110.

Figure 2:
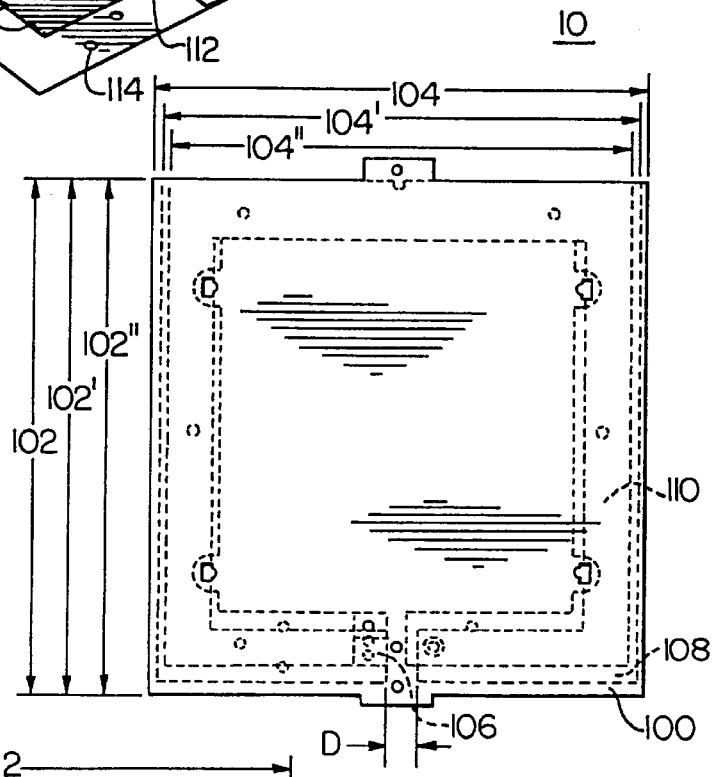
FIG. 2 shows a top view of the embodiment disclosed in FIG. 1, showing inter alia that the two ring radiators of the preferred embodiment are of different lengths.

FIG. 2 is a top view of the embodiment shown in FIG. 1, it can be seen that the first or lower ring radiator 108 has exterior dimensions greater than those of the upper ring radiator 110. As shown in FIG. 2, the ground plane 100 is substantially square having a length dimension 102 and a width dimension 104 as shown. The lower ring radiator 108 has a length dimension equal to 102' and a width dimension equal to 104'. The upper ring radiator 110 has a slightly smaller length 102" and a slightly smaller width 104". The different dimensions of the two radiators 108,110 coupled with the relative spacing to the ground plane 100 produce the different resonant frequencies of the antenna. Alternate embodiments of the antenna might include three or more such stacked ring radiators to produce three or more resonant frequencies.

The antenna depicted in FIG. 1, provides a compact, low profile vertically polarized antenna with two distinct resonant frequencies. The resonant frequencies of the antenna are established principally by the length or perimeter dimension of the ring radiators 108, 110. These resonant frequencies are also affected by the relative spacing between the two radiators and the ground plane 100. The resonant frequencies will also be affected by the spacing between the open end of each radiator 108, 110 and the shorting post 106, this spacing identified by reference letter "D" in FIG. 2.

FIG. 1 shows two input feed points 112, 114 for the ring radiators 108, 110 respectively. In the preferred embodiment, the antenna 10 has a characteristic 50-ohm impedance empirically achieved by the placement of the input feed points 112, 114 with respect to their linear distance from the shorting post 106.

When used with a low earth orbit satellite communication system, one ring radiator can be tuned to have a resonant frequency substantially equal to the transmit frequency of a satellite such that said ring radiator becomes the receive element for a receiver coupled to the antenna 10. Similarly the other ring radiator can have a resonant frequency adjusted to equal the receiver frequency of the satellite whereupon that radiator becomes the transmit element for a transmitter coupled to the antenna 10. By using two separate input feed points into the separate antenna elements, no lossy antenna coupler is required, substantially improving the antennas' performance and reducing the cost of providing satellite communications.

In the preferred embodiment, the radiators 108, 110 were tuned to have resonant frequencies in the VHF-frequency band. In the preferred embodiment, the upper or second ring radiator 110 was physically and electrically shorter and had a resonant frequency between 148 and 150 MHz. The first or lower ring radiator 108 was physically and electrically longer thereby having a lower resonant frequency of between 137 and 138 MHz. To achieve the resonant frequencies, the ring radiators 108, 110 were each roughly six to seven inches in length on a side. The resonant frequencies of the antenna are scaleable. By lengthening the perimeter of the radiators 108, 110, much lower resonant frequencies would be achievable. Conversely, reducing the perimeter dimension would achieve much higher resonant frequencies.

The first or lower ring radiator 108 was positioned approximately 1.25 inches above and substantially parallel to the ground plane 100. The second or upper ring radiator 110 was positioned slightly above ring radiator 108 approximately 2 inches above the ground plane. It was empirically determined that inclining the planes in which the ring radiators lie with respect to the ground plane 100 improved antenna tuning. Accordingly, the ring radiators 108 and 110 do not actually lie in parallel planes with respect to each other; rather the ground plane 100 lies in a first geometric plane while the ring radiators 108, 110 lie in slightly inclined planes with respect to the ground plane and each other.

The resonant frequency of the ring radiators is affected not only by their physical length, determined by the sum of the lengths of the sides, but also by the thickness and width of the metallic material, as well as their spacing with respect to each other and the ground plane and the separation of the free end from the ground post also affected the resonant frequency. Tuning the material is achieved by removing material from the open or free end of the radiators or by adding or subtracting material from the loops. Reducing the thickness of the material also affects the resonant frequency, albeit not as much as the width or physical length.

Figure 3:
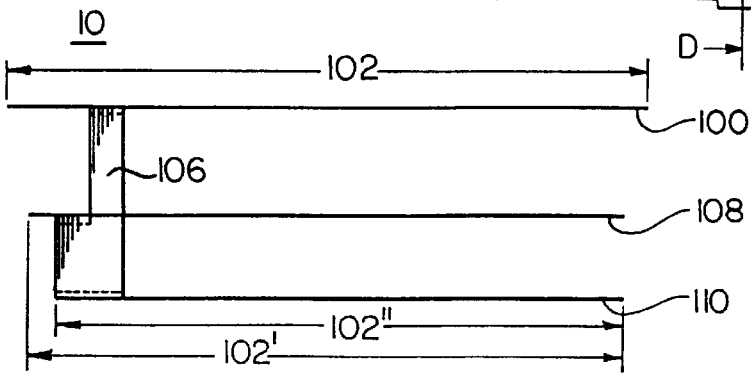
FIG. 3 shows a side elevation of the embodiment shown in FIG. 1 depicting the relative spacing of the elements and the ground plane.

FIG. 3 shows a side view of the antenna 10 depicting the shorting post 106 and the ground plane 100, and the first and second ring radiators 108, 110. FIG. 3 also shows that the distance along at least the side shown therein of the two ring radiators is not identical attributable to the two different resonant frequencies of the two radiators 108, 110.

The invention disclosed herein provides a low profile antenna that can be hidden inside a plastic or other nonconductive housing. It provides a compact efficient radiator with performance superior to single antenna that use a duplexer, circulator or a switch to switch between a transmitter and a receiver. Rather than using devices such as duplexers or circulators to use a single antenna, the two element antenna disclosed herein is far more efficient, more cost effective yet compact enough that it can be concealed within a housing that can be mounted to a consumers house, a vehicle, or other structure and remain inconspicuous.

What is claimed is:

1. A top-loaded, vertically polarized antenna having two input feed points comprised of:

a) ground plane means for providing an electrical reference potential for signals received and transmitted by said antenna;

b) shorting post means, affixed substantially orthogonal to said ground plane means, for supporting electronic elements to electrically load said antenna;

c) a first antenna loading means for providing top loading and for providing a first resonant frequency for said antenna, wherein said first antenna loading means is comprised of a strip of conductive material of a predetermined length and width formed into a substantially rectangular ring, lying substantially in a plane, having a first end affixed to said shorting post means, having a second end forming a capacitance with respect to said shorting post means;

d) a second antenna loading means for providing top loading and for providing a second resonant frequency for said antenna;

e) a first input means for coupling electrical signals to and from said first antenna loading means; and f) a second input means for coupling electrical signals to and from said second antenna loading means.

2. The antenna of claim 1 wherein said first input means is comprised of a cable electrically coupled to said first antenna loading means.

3. The antenna of claim 1 wherein said second input means is comprised of a cable electrically coupled to said second antenna loading means.

4. The antenna of claim 1 wherein said ground plane means is a substantially rectangular, substantially planar, conductive plate.

5. The antenna of claim 1 wherein said antenna has at least two resonant frequencies.

6. A top-loaded, vertically polarized antenna having two input feed points comprised of:

a) ground plane means for providing an electrical reference potential for signals received and transmitted by said antenna;

b) shorting post means, affixed substantially orthogonal to said ground plane means, for supporting electronic elements to electrically load said antenna;

c) a first antenna loading means for providing top loading and for providing a first resonant frequency for said antenna;

d) a second antenna loading means for providing top loading and for providing a second resonant frequency for said antenna, wherein said second antenna loading means is comprised of a strip of conductive material of a predetermined length and width formed into a substantially rectangular ring, lying substantially in a plane, having a first end affixed to said shorting post means, having a second end forming a capacitance with respect to said shorting post means;

e) a first input means for coupling electrical signals to and from said first antenna loading means; and f) a second input means for coupling electrical signals to and from said second antenna loading means.

7. The antenna of claim 6 wherein said first input means is comprised of a cable electrically coupled to said first antenna loading means.

8. The antenna of claim 6 wherein said second input means is comprised of a cable electrically coupled to said second antenna loading means.

9. The antenna of claim 6 wherein said ground plane means is a substantially rectangular, substantially planar, conductive plate.

10. The antenna of claim 6 wherein said antenna has at least two resonant frequencies.

11. A top-loaded, vertically polarized antenna having two input feed points comprised of:

a) a substantially planar ground plane;

b) a shorting post, affixed substantially orthogonal to said substantially planar ground plane;

c) a first ring radiator comprised of a first length of conductive material formed into a substantially rectangular loop having a first end coupled to said shorting post and having its second end located proximate to said shorting post thereby capacitively coupling said second end to said shorting post;

d) a second ring radiator comprised of a second length of conductive material formed into a substantially rectangular loop having a first end coupled to said shorting post and having its second end located proximate to said shorting post thereby capacitively coupling said second end to said shorting post;

e) a first input feed point located on said first ring radiator;

f) a second input feed point located on said second ring radiator.

12. The antenna of claim 11 wherein said first input feed point located on said first ring radiator is comprised of a cable electrically coupled to said first ring radiator.

13. The antenna of claim 11 wherein said second input feed point located on said second ring radiator is comprised of a cable electrically coupled to said second ring radiator.

14. The apparatus of claim 11 wherein said first input feed point located on said first ring radiator is comprised of a cable electrically coupled to said first ring radiator approximately one inch from said shorting post.

15. The apparatus of claim 11 wherein said second input feed point located on said second ring radiator is comprised of a cable electrically coupled to said second ring radiator at least one inch from said shorting post.

16. The antenna of claim 11 wherein said ground plane and said first ring radiator lie in substantially parallel planes.

17. The antenna of claim 11 wherein at least part of said first ring radiator lies in a plane inclined with respect to said ground plane.

18. The antenna of claim 11 wherein at least part of said second ring radiator lies in a plane inclined with respect to said ground plane.

19. The antenna of claim 11 wherein said first ring radiator provides a first resonant frequency for said antenna.

20. The antenna of claim 11 wherein said second ring radiator provides a second resonant frequency for said antenna.

21. The antenna of claim 11 wherein said first ring radiator produces a first resonant frequency for said antenna between 130 and 150 MHz.

22. The antenna of claim 11 wherein said second ring radiator produces a second resonant frequency for said antenna between 130 and 150 MHz.

23. The antenna of claim 11 wherein said antenna has at least two resonant frequenices.

* * * * *